US005977927A

United States Patent [19]

Mandai et al.

[11] Patent Number: 5,977,927

[45] **Date of Patent: *Nov. 2, 1999**

[54] CHIP ANTENNA

[75] Inventors: Harufumi Mandai, Takatsuki; Kenji Asakura, Shiga-ken; Teruhisa Tsuru, Kameoka; Seiji Kanba, Otsu; Tsuyoshi Suesada, Omihachiman, all of Japan

[73] Assignee: Murata Manufacturing Co., Ltd., Japan

[ * ] Notice: This patent is subject to a terminal disclaimer.

[21] Appl. No.: 08/794,976

[22] Filed: Feb. 5, 1997

[30] Foreign Application Priority Data

Feb. 7, 1996 [JP] Japan ..... 8-021395

[51] Int. Cl.[6] ..... H01Q 1/24

[52] U.S. Cl. ..... 343/788; 343/895; 343/873

[58] Field of Search ..... 343/873, 788, 343/806, 895

[56] References Cited

U.S. PATENT DOCUMENTS

| | | | |
|---|---|---|---|
| 4,710,775 | 12/1987 | Coe | 343/727 |
| 4,839,659 | 6/1989 | Stern et al. | 343/788 |
| 4,992,636 | 2/1991 | Namiki | 426/107 |
| 5,151,649 | 9/1992 | Heroux | 324/127 |
| 5,341,148 | 8/1994 | Walter et al. | 343/742 |
| 5,748,149 | 5/1998 | Kawahata | 343/700 MS |
| 5,767,811 | 6/1998 | Mandai et al. | 343/702 |

FOREIGN PATENT DOCUMENTS

| | | |
|---|---|---|
| 743699 | 11/1996 | European Pat. Off. . |
| 759646 | 2/1997 | European Pat. Off. . |

*Primary Examiner*—Michael J. Tohar
*Assistant Examiner*—Anh Q Tran
*Attorney, Agent, or Firm*—Ostrolenk, Faber, Gerb & Soffen, LLP

[57] ABSTRACT

A chip antenna in which correct evaluation and inspection of a conductor can be performed regardless of the state of grounding. The chip antenna has a rectangular-prism-shaped substrate formed of a dielectric material comprising, e.g., barium oxide, aluminum oxide and silica. A copper or copper-alloy conductor is spirally wound within the substrate in the longitudinal direction. A feeding terminal for applying a voltage to the conductor and a free terminal are disposed on the surfaces of the conductor. One end of the conductor is attached to the feeding terminal, while the other end is connected to the free terminal.

19 Claims, 3 Drawing Sheets

CHIP ANTENNA

BACKGROUND OF THE INVENTION

1. Field of the Invention

The present invention relates generally to chip antennas and, more particularly, to chip antennas used in mobile communication apparatus for mobile communications and local area networks (LAN).

2. Description of the Related Art

It is demanded that antennas used for mobile communications and local area networks be small, and one type of antenna to satisfy this demand is a helical antenna.

The structure of a known type of helical antenna is shown in FIG. 5. A helical antenna generally indicated by 50 is constructed in the following manner. A linear conductor 51 is wound with a generally circular winding cross section 52 orthogonal to the winding axis C. One end of the conductor 52 is used as a feeding end 53, while the other end serves as a free end 54.

In the above-described helical antenna, evaluation and inspection of the conductor are performed by evaluating the antenna characteristics (resonant frequency, bandwidth, and so on) of the helical antenna. The antenna characteristics, however, vary depending on the state of grounding due to the structure of the antenna. Thus, the antenna characteristics of the helical antenna measured with a gaging instrument may differ from those of the antenna applied to practical use. It is, therefore, difficult to correctly evaluate and inspect a conductor used in a helical antenna.

SUMMARY OF THE INVENTION

Accordingly, it is an object of the present invention to provide a chip antenna, free from the above-described problem, in which correct evaluation and inspection of a conductor can be performed regardless of the state of grounding.

In order to achieve the above and other objects, according to the present invention, there is provided a chip antenna comprising: a substrate formed of at least one of a dielectric material and a magnetic material; at least one conductor disposed at least one of within the substrate and on a surface of the substrate; and a pair of terminals disposed on the surface of the substrate and connected to respective ends of the conductor.

In the above-described chip antenna, one of the pair of terminals may be utilized as a feeding terminal for applying a voltage to the conductor, while the other terminal may act as a free terminal.

According to the above description, the chip antenna of the present invention is provided with a pair of terminals connected to the respective ends of the conductor, thereby enabling correct and easy measurements of the resistance of the conductor with an LCR meter.

Other features and advantages of the present invention will become apparent from the following description of the invention which refers to the accompanying drawings.

DETAILED DESCRIPTION OF EMBODIMENTS OF THE INVENTION

Figure 1:
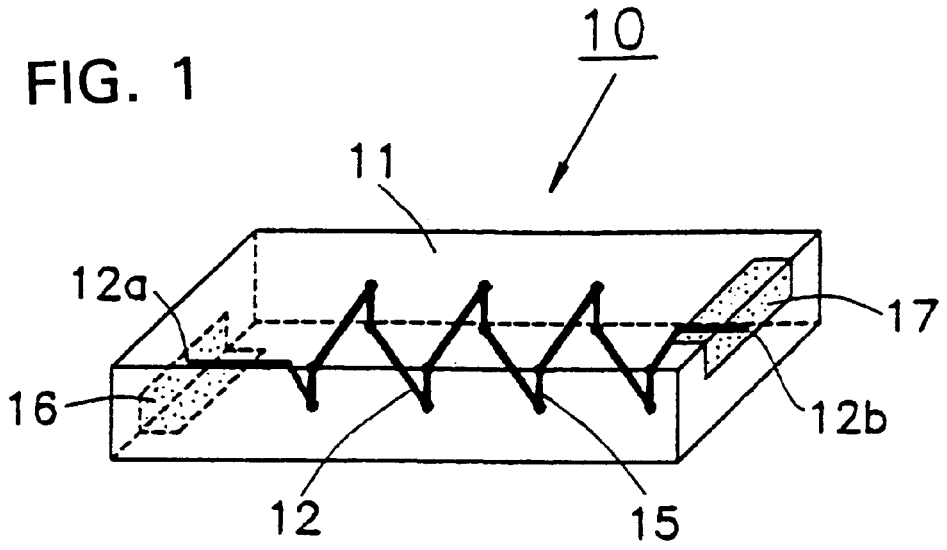
FIG. 1 is a perspective view of a chip antenna according to a first embodiment of the present invention.
Figure 2:
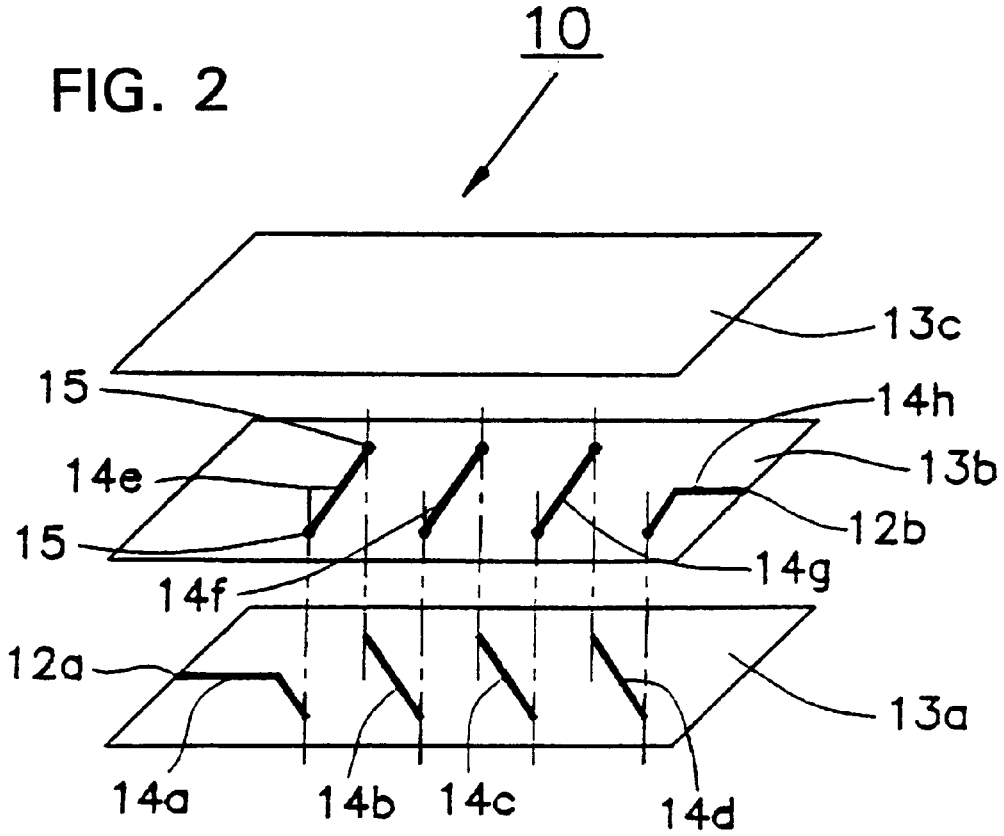
FIG. 2 is an exploded perspective view of the chip antenna shown in FIG. 1.

Embodiments of the present invention will now be described with reference to the drawings. A reference will first be made to FIG. 1. A chip antenna generally designated by 10 has a conductor 12 helically wound within a rectangular-prism-shaped substrate 11 in the longitudinal direction. The substrate 11 is constructed, as illustrated in FIG. 2, by stacking rectangular sheet layers 13*a* through 13*c* formed of a dielectric material (relative dielectric constant: approximately 6.1) comprising barium oxide, aluminum oxide and silica.

Disposed on the surfaces of the sheet layers 13*a* and 13*b* by means of printing, vapor deposition, cladding or plating are copper-made or copper-alloy-made conductive patterns 14*a* through 14*h* formed in a linear shape or generally in a "V"-shape. Further, via-holes 15 are formed in predetermined positions (one end or both ends of each of the conductive patterns 14*e* through 14*h*) on the sheet layer 13*b* along the thickness of the substrate 11.

The sheet layers 13*a* through 13*c* are then stacked on each other to connect the conductive patterns 14*a* through 14*h* through the via-holes 15. Thus, the conductor 12 having a rectangular cross section spirally wound inside the substrate 11 in the longitudinal direction can be constructed. A feeding terminal 16 for applying a voltage to the conductor 12 is disposed over two surfaces of the substrate 11, and a free terminal 17 is oppositely disposed over two surfaces of the substrate 11. One end 12*a* (one end of the conductive pattern 14*a*) of the conductor 12 is extended to the edge surface of the substrate 11 to be attached to the feeding terminal 16. In contrast, the other end 12*b* (one end of the conductive pattern 14*h*) is extended to the other edge surface of the substrate 11 to be connected to the free terminal 17. Nothing other than the end 12*b* of the conductor 12 is connected to this free terminal 17.

Figure 3:
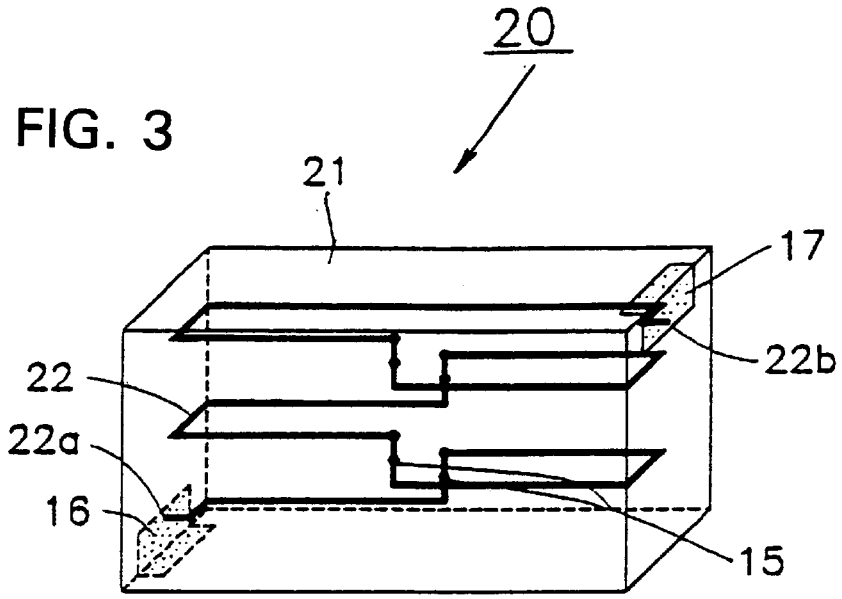
FIG. 3 is a perspective view of a chip antenna according to a second embodiment of the present invention.

A reference will now be made to FIG. 3 illustrating a chip antenna according to a second embodiment of the present invention. A chip antenna generally indicated by 20 differs from the antenna 10 of the previous embodiment in that a conductor 22 is spirally wound along the height of a substrate 21. In this antenna 20, one end 22*a* of the conductor 22 is fixed to the feeding terminal 16, while the other end 22*b* is attached to the free terminal 17. The other constructions are identical or similar to the chip antenna 10 of the first embodiment, and a detailed explanation thereof will thus be omitted by designating the same elements by like reference numerals.

Figure 4:
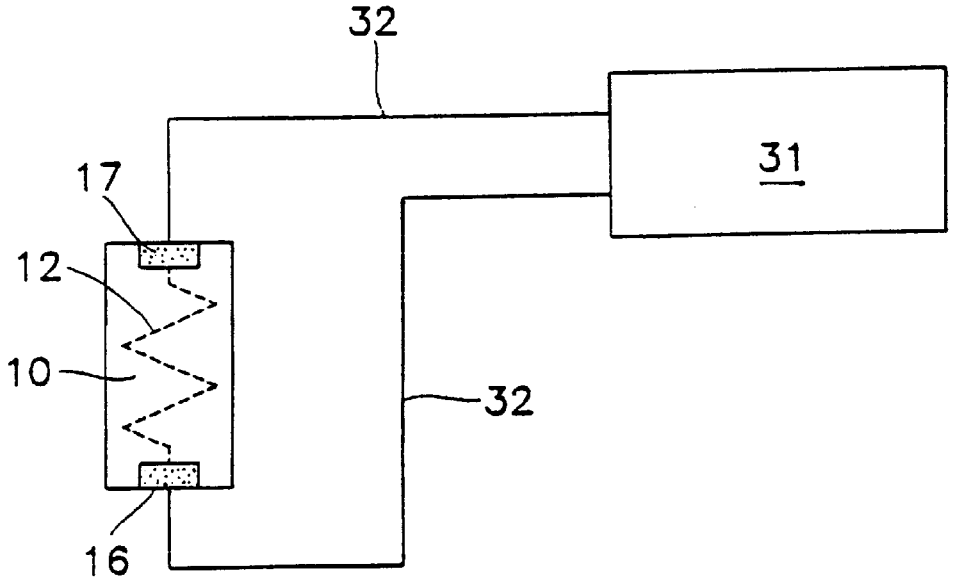
FIG. 4 is a schematic circuit diagram for evaluating the resistances of the conductors of the chip antennas shown in FIGS. 1 and 3.
Figure 5:
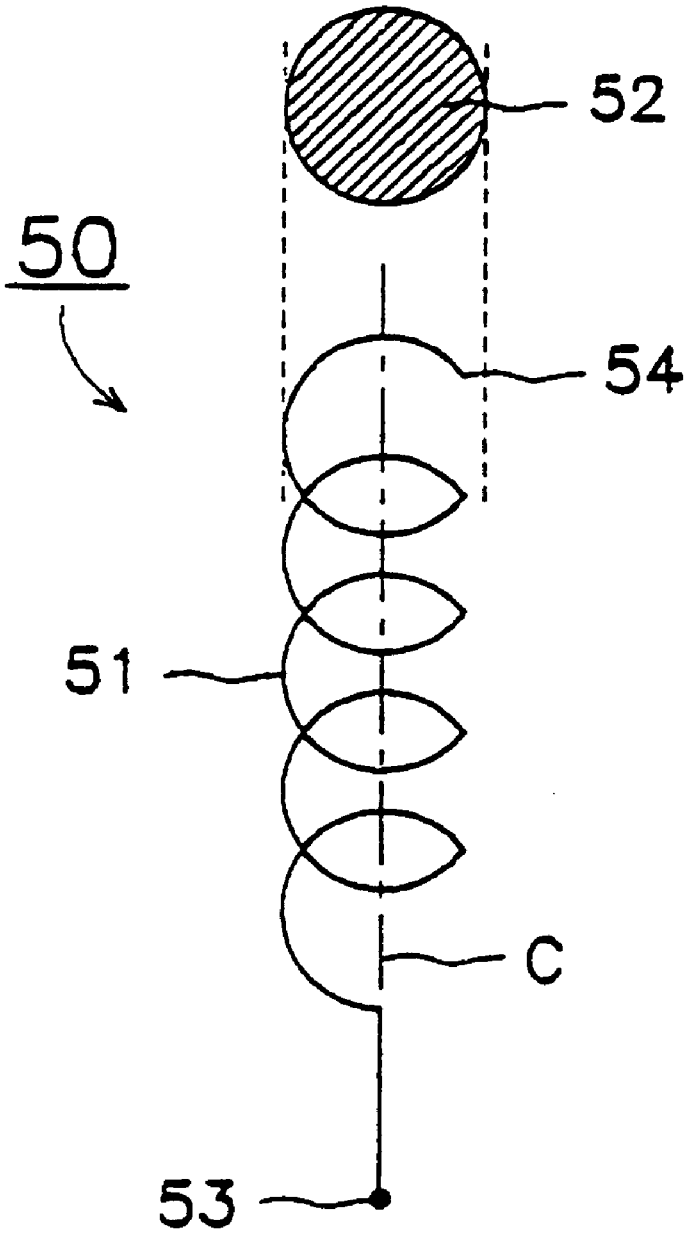
FIG. 5 illustrates the structure of a known type of helical antenna.

FIG. 4 is a diagram illustrating a schematic circuit for evaluating the resistance of the conductor 12 of the chip antenna 10 of the first embodiment. Both the feeding terminal 16 and the free terminal 17 of the antenna 10 are respectively connected to an LCR meter 31 through cables 32, 32, thereby measuring the resistance of the conductor 12. Alternatively, the resistance may be determined with an evaluation instrument (not shown). In the chip antenna 20, as well as in the antenna 10, the resistance of the conductor 22 may be evaluated in a manner similar to the above method.

The aforedescribed embodiments have been explained in which the substrate of the chip antenna is formed of a dielectric material comprising barium oxide, aluminum oxide and silica. This is not, however, exclusive, and the substrate may be formed of a dielectric material comprising titanium oxide and neodymium oxide, a magnetic material comprising nickel, cobalt and iron, or a combination of a dielectric material and a magnetic material. Also, in the above-described embodiments the substrate is formed in a rectangular-prism shape, but it may be formed in another shape, such as a cube, cylinder, pyramid, cone or sphere.

Moreover, although in this embodiment the conductor of the chip antenna is spirally wound, it may be wound in a meandering shape, e.g., a sinusoidal or triangular shape disposed in a single plane or in a plurality of planes. Further, the foregoing embodiments have been explained in which the conductor of the chip antenna is formed inside the substrate. However, the conductor may be disposed on a surface of the substrate, or both within and on a surface of the substrate. Additionally, more than one conductor may be formed, in which case, a plurality of resonant frequencies may be provided for a resulting chip antenna.

Further, a pair of terminals, i.e., a feeding terminal and a free terminal, are disposed on the surfaces of the substrate of the chip antenna. A mounting terminal may also be provided to mount a chip antenna on a mounting substrate. The positions of the feeding terminal and the free terminal on the substrate designated in these embodiments are not essential to carry out the present invention.

As will be clearly understood from the foregoing description, the chip antenna of the present invention offers the following advantages. A pair of terminals connected to the respective ends of the conductor are provided for the chip antenna, thereby stably and readily measuring the resistance of the conductor with an LCR meter. It is thus possible to perform stable and easy evaluation and inspection of the conductor irrespective of the state of grounding. Additionally, one of the pair of terminals is utilized as a feeding terminal, while the other terminal acts as a free terminal. The antenna can thus be used as a helical antenna.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a substrate comprising at least one of a dielectric material and a magnetic material, the substrate having a surface and having at least a portion of the surface comprising a flat surface to be mounted on a mounting board;

at least one conductor disposed at least one of within the substrate and on the surface of said substrate; and a pair of terminals disposed on the surface of said substrate and connected to respective ends of said conductor;

said substrate comprising a plurality of layers stacked on top of each other, the stacked layers establishing a direction normal to the stacked layers, the conductor being disposed spirally and having a spiral axis extending perpendicular to the direction normal to the stacked layers.

2. The chip antenna of claim 1, wherein one of said pair of terminals is utilized as a feeding terminal for applying a voltage to said conductor, the other terminal serving as a free terminal.

3. The chip antenna of claim 1, wherein the conductor is disposed within the substrate.

4. The chip antenna of claim 3, wherein the substrate comprises a plurality of layers, selected ones of the layers having selected portions of the conductor disposed on surfaces thereof, via holes being provided in at least one of the layers for connecting respective portions of the conductor on different layers together when the layers are joined together to form said substrate.

5. The chip antenna of claim 1, wherein the conductor is disposed on the surface of the substrate.

6. The chip antenna of claim 1, wherein the substrate has a plurality of surfaces and the conductor is disposed on selected ones of the plurality of surfaces.

7. The chip antenna of claim 1, wherein the conductor is disposed partly within the substrate and partly on the surface of the substrate.

8. The chip antenna of claim 1, wherein the conductor has a helical shape.

9. The chip antenna of claim 8, wherein the conductor has a rectangular cross section.

10. The chip antenna of claim 1, wherein the substrate comprises a combination of a dielectric material and a magnetic material.

11. The chip antenna of claim 1, wherein the substrate comprises one of a rectangular prism, a cube, cylinder, pyramid, cone and sphere.

12. The chip antenna of claim 1, wherein the conductor comprises copper or a copper alloy.

13. The chip antenna of claim 1, further comprising an instrument for measuring at least one electrical characteristic of the conductor via said pair of terminals.

14. The chip antenna of claim 1, wherein the conductor has a meandering shape.

15. The chip antenna of claim 14, wherein the meandering shape is disposed in a plane.

16. The chip antenna of claim 1, further comprising a mounting terminal disposed on a surface of the substrate.

17. The chip antenna of claim 1, wherein said substrate has at least two major surfaces, said pair of terminals being symmetrically disposed on the surface of said substrate such that both of said two major surfaces can be mounted on a circuit board.

18. The chip antenna of claim 17, wherein said pair of terminals are extended from one of said major surfaces to a side surface of the substrate.

19. The chip antenna of claim 17, wherein one of said pair of terminals is connected to a fixing electrode located on a circuit board when the substrate is fixed on the circuit board.

* * * * *